United States Patent [19]

Van Tuyl et al.

[11] Patent Number: 4,878,325

[45] Date of Patent: Nov. 7, 1989

[54] TWO PIECE ADJUSTABLE, REUSABLE METAL DOOR FRAME

[76] Inventors: James E. Van Tuyl; Clifford A. Larson, both of 8380 Pearl Rd. #102, Strongsville, Ohio 44136

[21] Appl. No.: 228,822

[22] Filed: Aug. 2, 1988

Related U.S. Application Data

[63] Continuation of Ser. No. 947,108, Feb. 25, 1987, abandoned.

[51] Int. Cl.[4] ..... E06B 1/04

[52] U.S. Cl. ..... 52/217; 49/505

[56] References Cited

U.S. PATENT DOCUMENTS

| | | | |
|---|---|---|---|
| 1,048,988 | 12/1912 | Mayo, Sr. | 52/217 X |
| 2,742,117 | 4/1956 | Tolman | 52/213 X |
| 2,853,161 | 9/1958 | Mascari | 52/217 X |
| 3,571,995 | 3/1971 | Kasprzak | 52/217 X |
| 3,793,788 | 2/1974 | Collins | 52/217 X |
| 4,128,977 | 12/1978 | Schubeis | 52/217 X |
| 4,179,849 | 12/1979 | Kuffner | 52/213 X |

*Primary Examiner*—Carl D. Friedman

[57] ABSTRACT

An adjustable, reusable door frame includes in cross-section, a first L-shaped member (C) and a second L-shaped member (G) which overlap sheet rock surfaces (B, BB) of an untrimmed wall opening. The first member has a first projection ($D_p$) which includes a doorstop extension ($C_e$) which projection overlaps a second projection ($G_p$) of the second member. A mounting leg extending projection (D) extends from an inside surface of the first memeber and attaches to a mounting bracket (H). Bracket (H) is attached to a stud (A) which defines an inside face of the untrimmed opening. An attaching bracket (E) extends between the first and second members and is fastened thereto by fasteners. A hinge side assembly includes slotted holes (FF) through which fasteners securing attaching bracket (E) extend. When door hinges are mounted to the hinge side assembly, the fasteners securing the door frame together are covered. Similarly a lock side assembly of the door frame includes fasteners extending through slotted holes (KK) which serve to hold the first and second members together which are covered when a lock plate is installed in the door frame.

9 Claims, 8 Drawing Sheets

TWO PIECE ADJUSTABLE, REUSABLE METAL DOOR FRAME

This is a continuation of co-pending application Ser. No. 947,108 filed on Feb. 25, 1987 now abandoned.

SUMMARY OF THE INVENTION

The door frame which consists of one each inner and outer pieces as well as mounting brackets allows for easy mounting on warped or bowed wall (sheetrock). The door frame also allows for easy mounting in oversized, undersized or out of plum (square) trim stud and header.

BEST MODES FOR CARRYING OUT INVENTION

Figure 1:
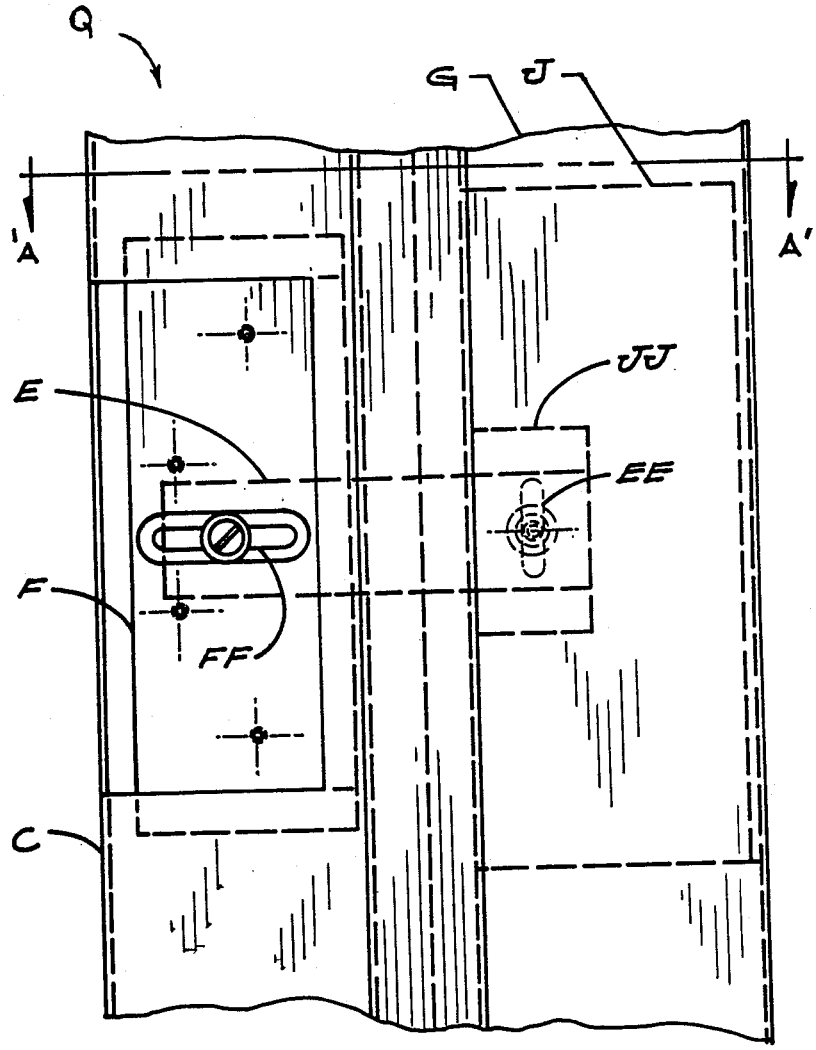
FIG. 1 is a partial side view of a hinge side of an assembled door frame of the preferred embodiment of the present invention.
Figure 2:
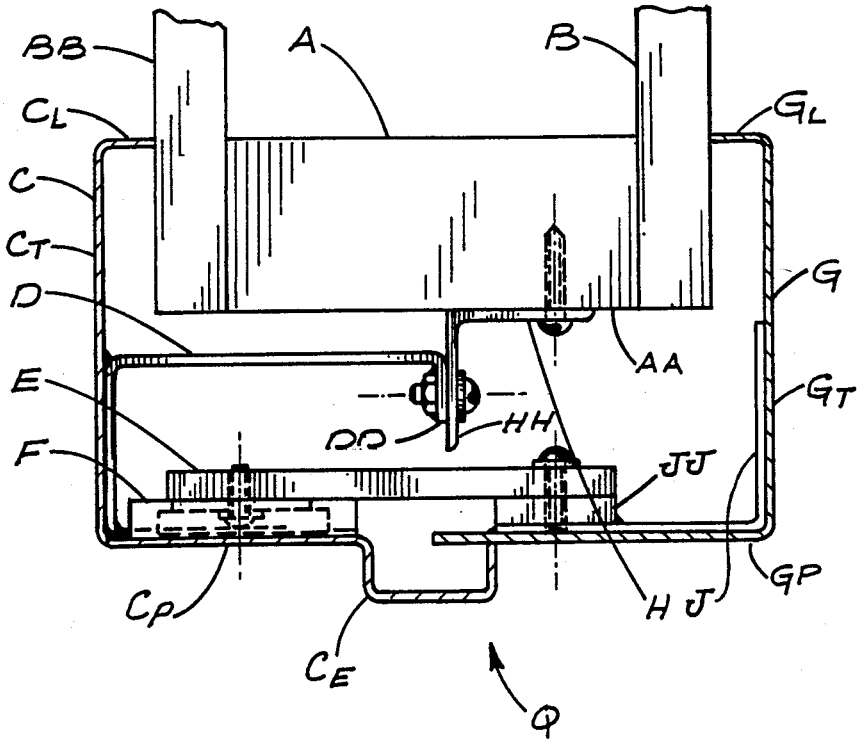
FIG. 2 is a sectional view of the hinge side of the door frame shown in FIG. 1 sectioned along line A'—A'.

Referring now to the drawings and specifically to FIG. 1 there is shown therein a hinge side assembly Q of a door frame of the preferred embodiment of the present invention. The frame is comprised of a first half member C and a second half member G. As shown in FIG. 2 first and second members C and G are generally L-shaped in cross-section and are preferably of formed metal construction.

The door frame is mounted to an untrimmed door opening. The opening is bounded by a stud A with sheet rock B and BB on the Exterior and interior sides of the opening respectively. Stud A includes an inward facing butt surface AA which defines the opening.

Figure 5:
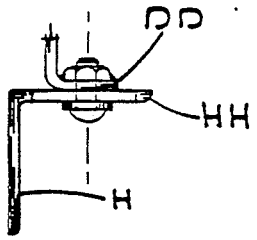
FIG. 5 is a top view of an L-shaped mounting bracket fastened to a portion of a mounting leg of a first door frame member.
Figure 6:
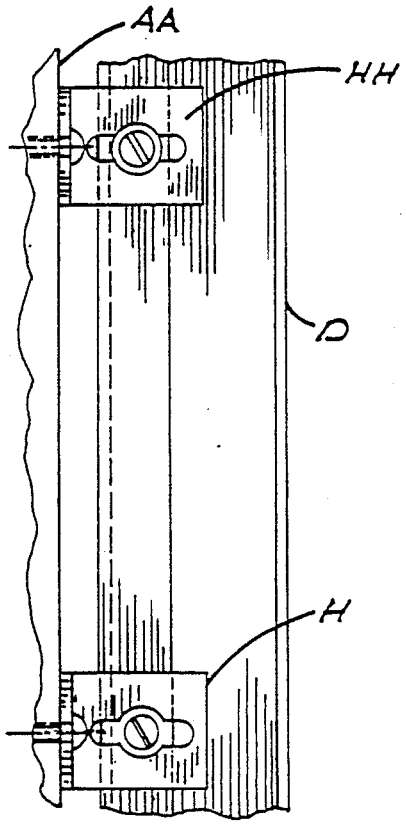
FIG. 6 is a right side view of the L-shaped mounting bracket shown in FIG. 5 mounted to a butt surface of a stud and attached to a mounting leg of a first door frame member.

An L-shaped mounting bracket H is mounted to stud A by a screw which extends through a hole in the bracket. Bracket H includes a flush leg adjacent to the butt surface and a projecting leg HH which extends outward therefrom. Projecting leg HH includes a slotted hole as shown in FIGS. 5 and 6.

First member C includes a first projection $C_P$ extending generally parallel to butt surface AA and an inside trim face $C_T$ generally perpendicular thereto. The inside trim face terminates in an inturned lip $C_L$ which contacts sheet rock BB. First projection $C_P$ also incorporates a doorstop extension portion $C_E$. When a door is mounted in the frame, the door will be in abutting relation with doorstop extension $C_E$ in the closed position.

First member C also includes a mounting leg projection D extending from the inside to trim face $C_T$ generally parallel to first projection $C_P$. Mounting leg projection D terminates in a foot portion DD which extends against projecting leg HH of bracket H and is attached thereto by a fastener as shown in FIGS. 5 and 6. In the preferred form of the invention mounting leg projection D is a formed metal piece welded to the interior of first member C.

Mounted on an inside surface of first projection $C_P$ is a bracket F. Bracket F is preferably mounted by welding. An outward face of bracket F is accessible through a rectangular hole in first projection $C_P$. The outward face of bracket F incorporates a plurality of holes designed to accept mounting screws which are used to attach a door hinge to the door frame. Bracket F also incorporates a recessed slotted hole FF which enables width adjustment of the door frame as later explained.

Second member G includes a second projection $G_P$ extending parallel to and behind the doorstop extension portion of first projection $C_P$. Second member G also includes an outside trim surface $G_T$ generally perpendicular to surface $G_P$. Outside trim surface $G_T$ terminates in an inturned lip $G_L$ which abuts against sheet rock B.

A reinforcing bracket J is welded to the inside surfaces of second projection $G_P$ and outside trim surface $G_T$. Bracket J has a mounting block JJ welded thereon. Mounting block JJ includes a threaded hole for accepting a fastener.

An attaching bracket E extends between mounting block JJ on the second member and bracket F on the first member. Attaching bracket E includes a vertically slotted hole EE on the end adjacent mounting block JJ. A fastener extends through slotted hole EE into the mounting block. This enables vertical adjustment of bracket E. On the end adjacent bracket F, bracket E includes a fastener accepting hole which accepts a fastener extending through slotted hole FF. This enables the distance between first member C and second member G to be adjusted to accommodate walls of various widths.

Figure 8:
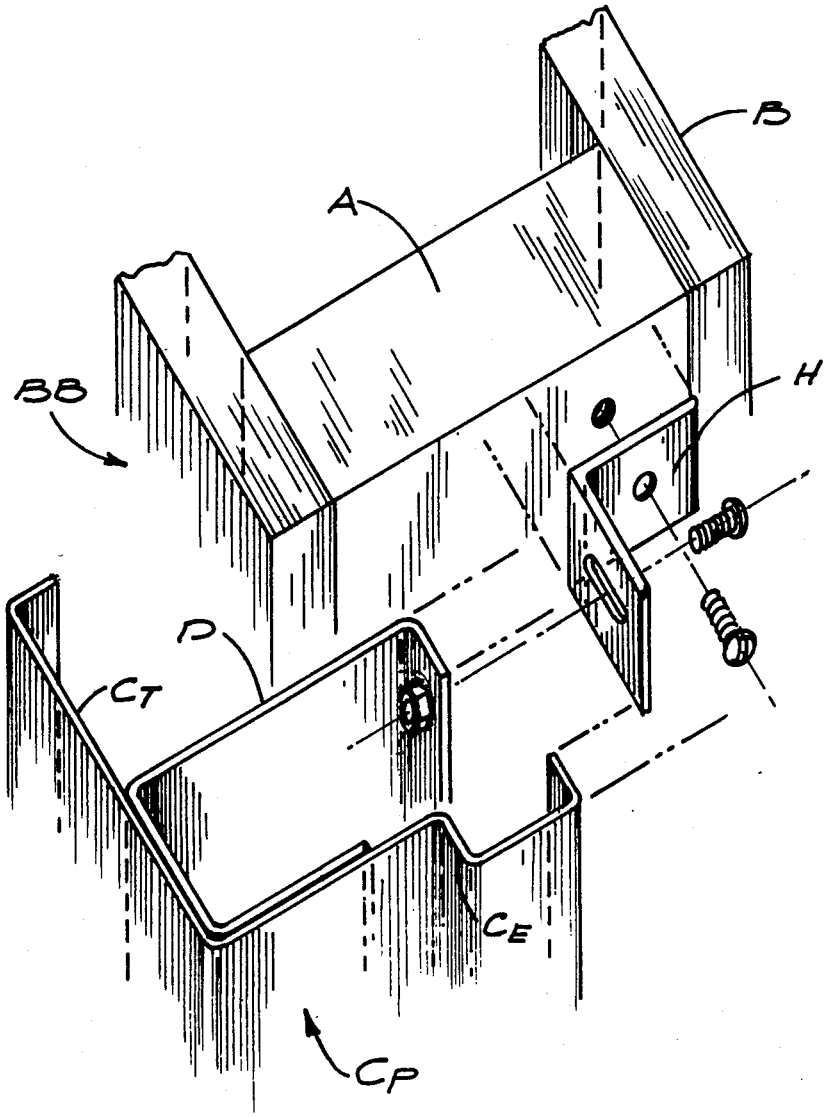
FIG. 8 is an exploded sectional view of the untrimmed door opening, L-shaped mounting bracket and first door frame member in relative positions.

In mounting the hinge side of the door frame, first member C is placed with lip $C_L$ against the surface of inside sheet rock BB. As shown in FIG. 8 bracket H is placed against surface AA with projecting leg HH against foot portion DD of mounting leg projection D. The flush leg of bracket H is fastened into place on stud A by a screw. Projecting leg HH is then fastened to foot portion DD with a fastener. The slotted hole in projecting leg HH enables lateral adjustment of the door to compensate for any "out of square" condition of the untrimmed opening. In the preferred form of the invention a plurality of brackets H are used to hold the assembly to the stud.

Figure 9:
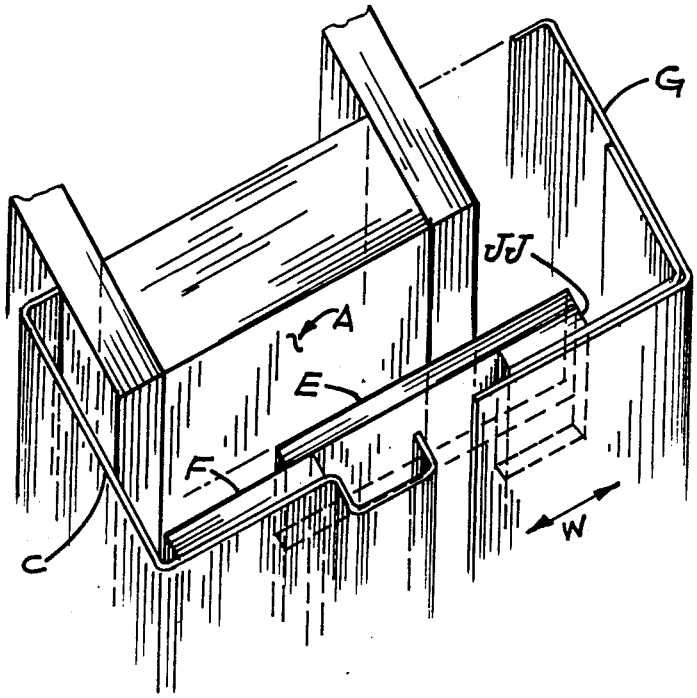
FIG. 9 is an exploded sectional view of the first and second door frame members in relative positions.

In assembling the door frame second member G is then brought into position such that second projection $G_P$ extends behind first projection $C_P$ as shown in FIG. 9. The fastener holding attaching bracket E to mounting block JJ is loosened so that the hole at the opposite end of attaching bracket E can be aligned with slot FF in bracket F. The fastener is then tightened so that bracket E is in fixed vertical position. Another fastener is then passed through slot FF into the opposed end of bracket E to hold first and second members C and G in fixed relation. In the preferred form of the invention multiple attaching brackets are spaced along the length of the assembly to hold the door frame members together. Because second projection $G_P$ extends behind and overlaps first projection $C_P$ and hole FF is elongated, the construction of the preferred form of present invention can accommodate a range of wall thicknesses as indicated by the arrow W in FIG. 9. Another advantage of the preferred form of the present invention is that when the hinges are mounted on bracket F the fasteners which hold the hinge side of the door frame together are hidden. This enhances the appearance of the door frame.

Figure 3:
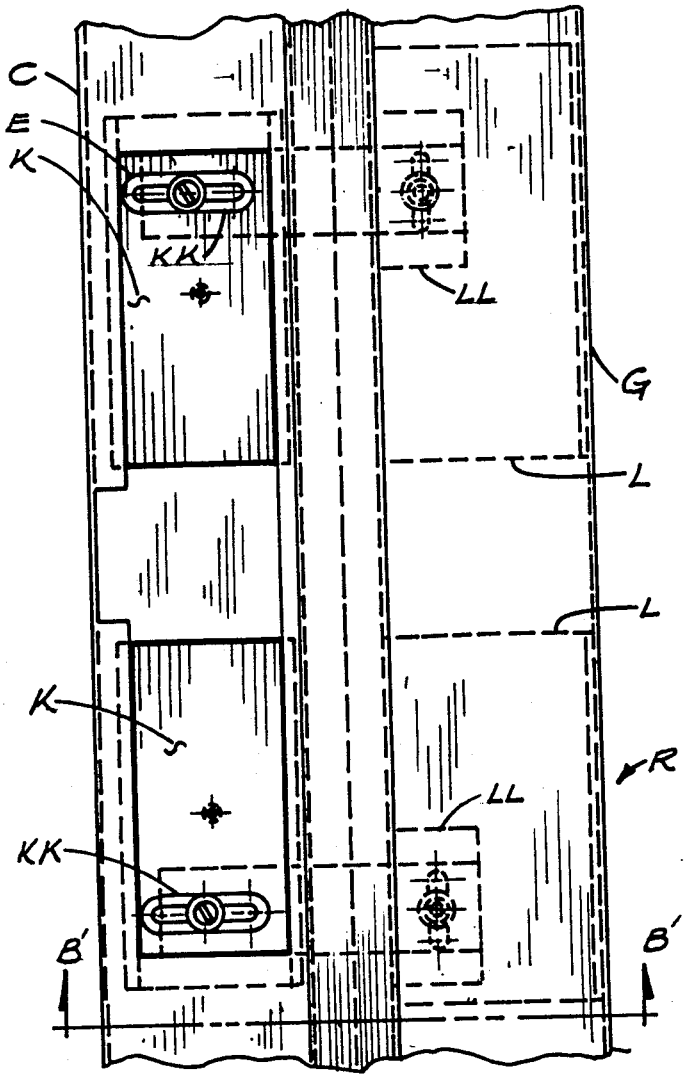
FIG. 3 is a partial side view of a lock side of an assembled door frame of the preferred form of the present invention.
Figure 4:
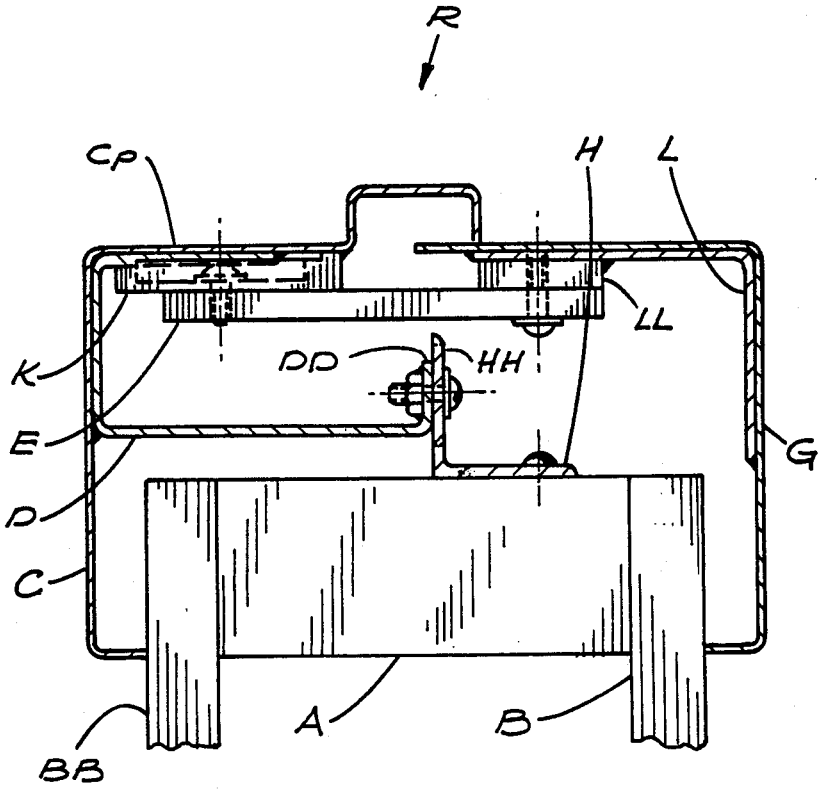
FIG. 4 is a sectional view of the lock side of the door frame shown in FIG. 3 sectioned along line B'—B'.

A lock side assembly R of the preferred embodiment of the door frame is shown in FIGS. 3 and 4. The lock side is a mirror image of the hinge side except that brackets F on the hinge side are replaced by a pair of elongated lock plate mounting brackets K. The faces of brackets K are accessible through access holes cut in first projection $C_P$ of the first member. Brackets K include mounting holes for mounting a lock plate. Brackets K also incorporate slotted holes KK which enable adjustable mounting of adjusting brackets E. An advantage of the preferred form of the present invention is that when a lock plate is mounted to bracket K, the slotted holes KK are hidden enhancing the overall appearance of the door.

The lock side R also includes support brackets L which function similarly to support brackets J on the hinge side. Support brackets L are welded to the inside of second member G. Support brackets L incorporate mounting blocks LL which function similarly to mounting blocks JJ on the hinge side. Thus the lock side assembly is fully adjustable in the same manner as the hinge side, and when assembled, creates a secure and attractive assembly because all the fasteners are hidden.

Figure 7:
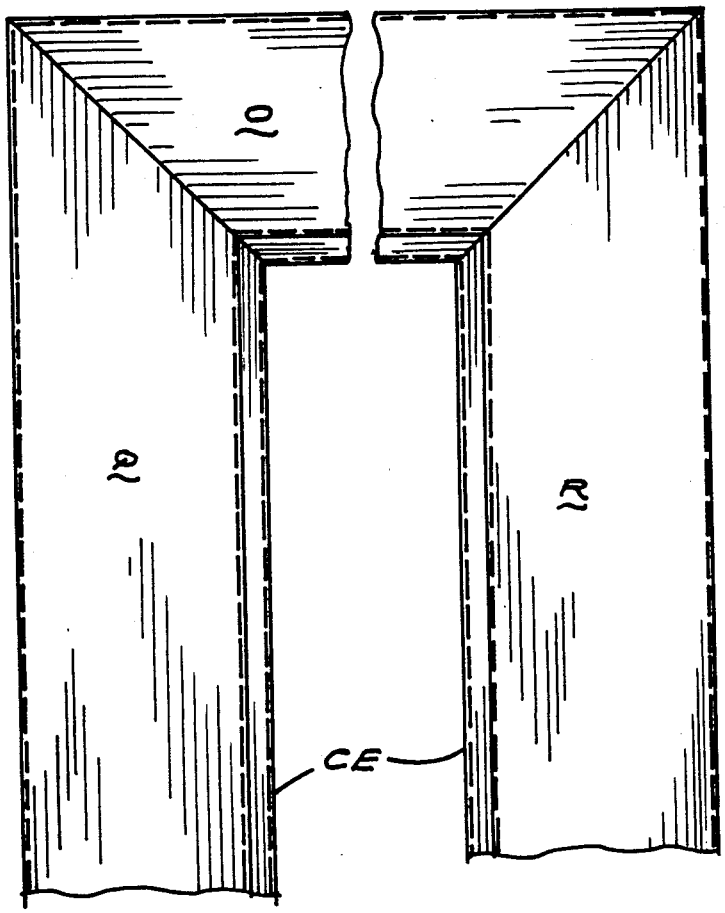
FIG. 7 is a front view of the assembled hinge, lock and header side assemblies of the door frame of the preferred embodiment of the invention.

As shown in FIG. 7, a fully framed door opening will have a door frame comprised of a hinge side assembly Q, a lock side assembly R, and a header side assembly O at the top. The header side assembly is constructed similarly to the hinge side and the lock side except that in the preferred form of the invention the first and second members which form the assembly are welded to the corresponding members on the hinge and lock sides. This enables the members of the header side to be held together by the hinge and lock sides without additional fasteners.

A further advantage of the preferred embodiment of the new door frame is that the fasteners which hold the frame members together are only accessible from the side of the wall into which the door swings as it is opened. This makes the door frame difficult to compromise from the opposite side of the wall. Further enhancing the security and appearance of the preferred embodiment is that the door is immediately adjacent all the fasteners in the closed position.

Thus the new two piece adjustable, reusable metal door frame of the present invention achieves the above stated objectives, eliminates difficulties encountered in the use of prior devices, solves problems and obtains the desirable results described herein.

In the foregoing description, certain terms have been used for brevity, clarity and understanding. However, no unnecessary limitations are to be implied therefrom because said terms are used for descriptive purposes and are intended to be broadly construed. Moreover, the descriptions and illustrations are by way of examples and the invention is not limited to the exact details shown or described.

Having described the features, discoveries and principles of the invention, the manner in which it is utilized and the advantages and useful results obtained, the new and useful structures, devices, elements, arrangements, parts, combinations, systems, equipment, operations, methods and relationships are set forth in the appended claims.

We claim:

1. An adjustable, variable width, reusable door frame for framing an untrimmed opening in a wall, said wall extending in a plane and separating a first region from a second region, comprising:

(a) a mounting bracket attached to said wall, said mounting bracket including a bracket leg extending generally parallel of said plane into said opening;

(b) a first member of generally L-shaped cross section, said first member including a first projection extending generally perpendicular of the plane of said wall, said first projection including a door stop extension; said first member further including a mounting leg extending generally parallel of said first projection to said bracket leg, said mounting leg disposed in spaced relation of said first projection and proximate said wall;

(c) first fastening means for fastening said bracket leg and said mounting leg;

(d) a second member of generally L-shaped cross section, said second member including a second projection proximate of said wall and in overlapping relation on said first projection, said second projection interfitting between said first projection and said mounting leg, said second projection variably positionable on said first projection enabling said frame to adjust to the width of said wall; and, (e) a joining fastener extending through said first and second projections for fastening said first projection and said second projection.

2. The door frame according to claim 1 wherein said first member is proximate said first region and said joining fastener is in spaced relation with said door stop extension toward said first region.

3. The door frame according to claim 2 wherein said joining fastener extends through a laterally elongated width adjusting hole in said first projection, whereby varying the position of said joining fastener in said width adjusting hole enables the frame to accept walls of various widths.

4. The door frame according to claim 3 and further comprising cover means for covering said screw means.

5. The apparatus according to claim 3 wherein said second member includes an inner surface and a mounting block mounted on said inner surface, and a said second projection includes a joining bracket accepting said joining fastener at a first end and having a vertically slotted hole at a second opposed end, and screw means fastening said second end to said mounting block, whereby said joining bracket is vertically adjustable to compensate for an out of square condition of said untrimmed opening.

6. The apparatus according to claim 5 wherein said opening includes a hinge side, a top side and a lock side and said door frame comprises a hinge side assembly, a header side assembly, and a lock side assembly, and further comprising at least one hinge accepting recess in said first member of said hinge side assembly for accepting a mounting surface of a hinge, and wherein at least one of said width adjusting screws on said hinge side assembly is positioned in said recess and is covered upon installation of a hinge in said recess.

7. The apparatus according to claim 6 wherein said first member of said lock side assembly includes a lock plate accepting recess for accepting a lock plate, and wherein at least one of said width adjusting screws of said lock side assembly is positioned in said lock plate accepting recess and is covered by said lock plate when upon installation of said lock plate in said recess.

8. The door frame according to claim 1 wherein said mounting leg of said first member terminates in a foot portion in abutting relation with said bracket leg of said mounting bracket; said bracket leg includes a slotted hole; and said first fastening means is a fastener extending through said slotted hole and accepted in said foot portion.

9. A reusable door frame for framing an untrimmed opening in a wall, said wall extending in a plane and separating a first region from a second region, comprising;

(a) a first member of generally L-shaped cross section, said first member including a first projection extending generally perpendicular to said plane of said wall and including a hinge accepting recess for accepting a mounting surface of a hinge;

(b) a second member of generally L-shaped cross section, said second member including a second projection proximate of said wall and in overlapping relation on said first projection; and (c) screw means for fastening said first projection and said second projection, said screw means positioned in said hinge accepting recess, whereby said screw means is rendered inaccessible upon acceptance of said mounting surface in said recess.

* * * * *